United States Patent [19]

Hinrichs

[11] Patent Number: 4,773,706

[45] Date of Patent: Sep. 27, 1988

[54] CHAIR, PARTICULARLY AN OFFICE CHAIR

[75] Inventor: Kurt Hinrichs, Weissach, Fed. Rep. of Germany

[73] Assignee: Dr. Ing. h.c.F. Porsche Aktiengesellschaft, Stuttgart, Fed. Rep. of Germany

[21] Appl. No.: 70,240

[22] Filed: Jul. 6, 1987

[30] Foreign Application Priority Data

Jul. 3, 1986 [DE] Fed. Rep. of Germany ..... 3622272

[51] Int. Cl.[4] ..... A47C 3/00

[52] U.S. Cl. ..... 297/300; 297/316

[58] Field of Search ..... 297/300, 301, 302, 316, 297/303, 304, 320, 322

[56] References Cited

U.S. PATENT DOCUMENTS

| | | | |
|---|---|---|---|
| 3,356,413 | 12/1967 | Raoke et al. | 297/300 |
| 3,369,840 | 2/1968 | Dufton | 297/303 |
| 4,411,469 | 10/1983 | Drabert et al. | 297/300 |
| 4,502,729 | 3/1985 | Locher | 297/300 X |
| 4,533,177 | 8/1985 | Latone | 297/301 |
| 4,668,012 | 5/1987 | Locher | 297/300 |
| 4,684,173 | 8/1987 | Locher | 297/300 |

FOREIGN PATENT DOCUMENTS

| | | |
|---|---|---|
| 131553 | 1/1985 | European Pat. Off. . |
| 2651843 | 5/1978 | Fed. Rep. of Germany . |
| 7815567 | 9/1978 | Fed. Rep. of Germany . |
| 3316533 | 11/1984 | Fed. Rep. of Germany . |
| 3415555 | 2/1985 | Fed. Rep. of Germany . |
| 647138 | 12/1978 | Switzerland . |

*Primary Examiner*—Peter A. Aschenbrenner
*Attorney, Agent, or Firm*—Barnes & Thornburg

[57] ABSTRACT

A chair, particularly an office chair, has a vertically adjustable seat carrying means at which, by means of a control linkage, a seat plate that can be adjusted in its slope is coupled as well as a backrest are coupled. The backrest adjusts itself as a function of the slope of the seat plate. The control linkage comprises coupling elements that are held at the seat carrying means and are arranged in the shape of scissors and are coupled to seat parts of a seat surface that are flexibly connected with one another. By means of this coupling, an imaginary axis of rotation in the knee area is formed that is transversely extending and unchangeable and is located in front of the seat surface. This axis of rotation in the knee area is located in an intersecting line that is formed between a horizontal plane of the seat surface when in a basic adjusted position and a diagonal plane of one coupling element when in an inclined adjusted position. As a result, an uncomfortable sitting is avoided when the chair is adjusted because no change of the user's relevant support points takes place with respect to the chair as well as of the leg supporting points with respect to the contact surface of the chair.

11 Claims, 9 Drawing Sheets

CHAIR, PARTICULARLY AN OFFICE CHAIR

BACKGROUND AND SUMMARY OF THE INVENTION

The invention relates to a chair, particularly an office chair of the type having a seat plate that can be adjusted in its slope and a backrest which is adjustable as a function of the seat plate slope adjustment.

From German Application No. (DE-OS) 33 16 530, a chair is known, the backrest of which carries out an adjusting motion as a function of the slope of the seat plate via a control linkage. In the case of this chair, when the slope of the seat plate is adjusted, a lifting of the front edge of the seat plate is caused via control rods of this gear. In a comfort-reducing way, this results in a forced change of the original foot supporting point because of a so-called pulling-up of the legs. By means of the backrest that can be swivelled relative to the seat plate, a constant changing of the essential body supporting points at the chair is caused which also results in an effect that is disadvantageous with respect to the correct fitting of the clothes. Also, from DE-OS 34 15 555, a chair has become known that comprises a seat surface made of two parts that are flexibly connected with one another. The part that is located in the front is connected firmly with the seat carrying means and the pivoted rear part of the seat plate is articulated to a two-part backrest, the lower backrest part of which, in the area of the pelvis, is pivotably held at the rear plate part. As a result of this chair development, when the slope of the seat is adjusted, via a control linkage, a relative movement becomes possible between the rear part of the seat surface and the connecting lower seat backrest part, which also, in a comfort-reducing way, causes a friction effect between the backrest of the seat and the user's back.

An objective of the invention consists of providing a chair that, in its basic position and in its inclined positions, ensures a comfortable sitting without changing the user's relevant support points with respect to the chair as well as the leg supporting points at the contact surface of the chair.

According to the invention, this objective is achieved by constructing the chair seat plate with a front plate part and a rear plate part flexibly connected with one another and being supported by scissor shaped seat carrying supports and control coupling elements which accommodate relative pivotal adjustment of the plate parts with pivotal movement of the front plate part about a substantially fixed imaginary axis located in front of the chair at the location of the knees of a person sitting in the chair. In preferred embodiments, this imaginary axis is located at an intersection of a horizontal plane of the seat surface when in a basic horizontal seat adjusted position and an inclined plane of one of the coupling elements when in an inclined front seat part adjusted position.

Principal advantages that are achieved by means of the invention arise from the fact that, by means of the design of the kinematics, the front edge of the seat is lowered when the slope of the chair is adjusted and the seat plate swivels around an imagined axis of rotation located in front of it. This axis of rotation is preferably located in the ara of the user's knees, resulting in an unchanged supporting point for the feet, and at the same time relieving the thighs from load. As a result, according to the invention, an uncomfortable pressing in the hollows of the knees by a lifting of the front edge of the seat according to the state of the art is avoided.

Additional advantages are that the user's relevant support points with respect to the chair, because of the one-piece construction of the rear seat plate with the backrest according to preferred embodiments, are also unchanged when the slope is adjusted and a support of the pelvis is achieved without friction effects, i.e., relative movements between the back and the chair.

By investigating seats, it was found that an ergonomically comfortable holding of the seat is ensured when the front plate part of the seat surface is included to the horizontal with respect to the rear plate part at a ratio of 1:2. When the seat is adjusted by means of the control linkage, this ratio can also be maintained in the intermediate positions.

Other objects, advantages and novel features of the present invention will become apparent from the following detailed description of the invention when considered in conjunction with the accompanying drawings.

DETAILED DESCRIPTION OF THE DRAWINGS

Figure 1:
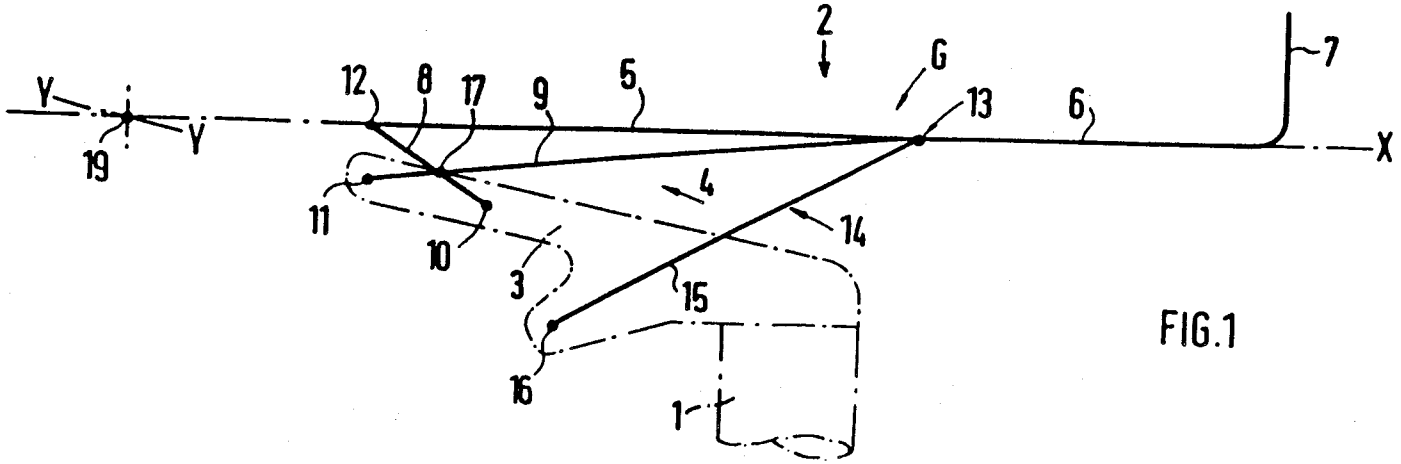
FIG. 1 is a diagrammatic representation of coupling elements of a control linkage for a chair in a basic position, constructed in accordance with a preferred embodiment of the present invention.

The chair according to FIGS. 1 to 5 comprises a frame 1 and a seat surface 2 that, via a seat carrying means 3, and a control linkage 4, is fastened at the frame 1. The seat surface 2 comprises two plate parts 5 and 6 that are connected with one another, in which case the plate part 6 that is located in the rear is an integral component of a backrest 7. The frame 1 has a spring element for the vertical adjustment and ends in a foot or support base.

The chair can be adjusted into a basic position G in which the seat surface 2 takes up a position in a horizontal plane X—X. Starting from this basic position G, the chair can be swung into an inclined position N, in which the front plate part 5 is located in a diagonal plane Y—Y, and the rear plate part 6 is in a diagonal plane Z—Z. Between the basic position G and the inclined position N, all intermediate positions are possible, in which case a locking takes place in any position via a corresponding device.

The control linkage 4 comprises essentially two coupling members 8, 9 that, are arranged in the shape of scissors between the plate parts 5 and 6 and the seat carrying means 3 being only schematically depicted as struts in FIGS. 1, 2, 3 and 5, for the purpose of clarity. These coupling elements 8 and 9 can be rotated against one another around a shaft 17, and on one side can be pivoted around horizontal shafts 10 and 11 at the seat carrying means 3, and on the other side, are coupled at the plate parts 5 and 6 around horizontal shafts 12 and 13*a*, as shown in detail in FIG. 2.

The rear plate part 6 is formed in one piece with the backrest 7 and has portions 14 that extend on both sides diagonally toward the front in the direction of the seat carrying means 3 via a joint 13 with a horizontal shaft 13*a*, said portions 14 forming the control arms 15*a*. These control arms 15*a* can be slid on a fixed horizontal shaft 16 (FIGS. 1 to 3) and at the same time, via the rear coupling (joint 13) of the front plate part 5 on the shaft 13*a*, can be pivoted relative to the front plate part 5, as shown in FIG. 3

The coupling elements 8 and 9 as well as the control arms 15 have such lengths and are coupled at the seat carrying means 3 and flexibly connected with the plate parts 5 and 6 in such a way that, in the inclined positions of the seat surface 2, an axis of rotation 19 is formed in the knee area. Axis of rotation 19 is located in its basic position G in the same horizontal plane X—X as the seat surface 2.

In operation, as the back 7 of the rear seat plate 6 inclines and drops downwardly (FIG. 1 to FIG. 3), the righthand end of lever arm 14 drops with shaft 13 as the lefthand lever arm 14 translates from the lefthand of slot 16 to the righthand of slot 16. Lowering of shaft 13 causes levers 5 and 9 to decrease their relative angularity from that shown in FIG. 1 to be parallel as shown in the extreme inclined position of FIG. 3. Because the lefthand end 19 of front plate 5 is connected via scissors linkage coupling member 8 to coupling member 9, link 8 will pivot about pivot 17 to also be in alignment with levers 5 and 9. This will lower the pivot 12 a certain distance, which distance is approximately equal to the lowering of shaft 13, and thus while the front seat plate has its right end lowered, its left end 19 remains essentially stationary at the horizontal axis X—X and the front seat plate 5 assumes a new orientation Y—Y. The slots 30, 28 allow the coupling member to rotate with the movement of shafts of shafts 12 and 10.

Figure 3:
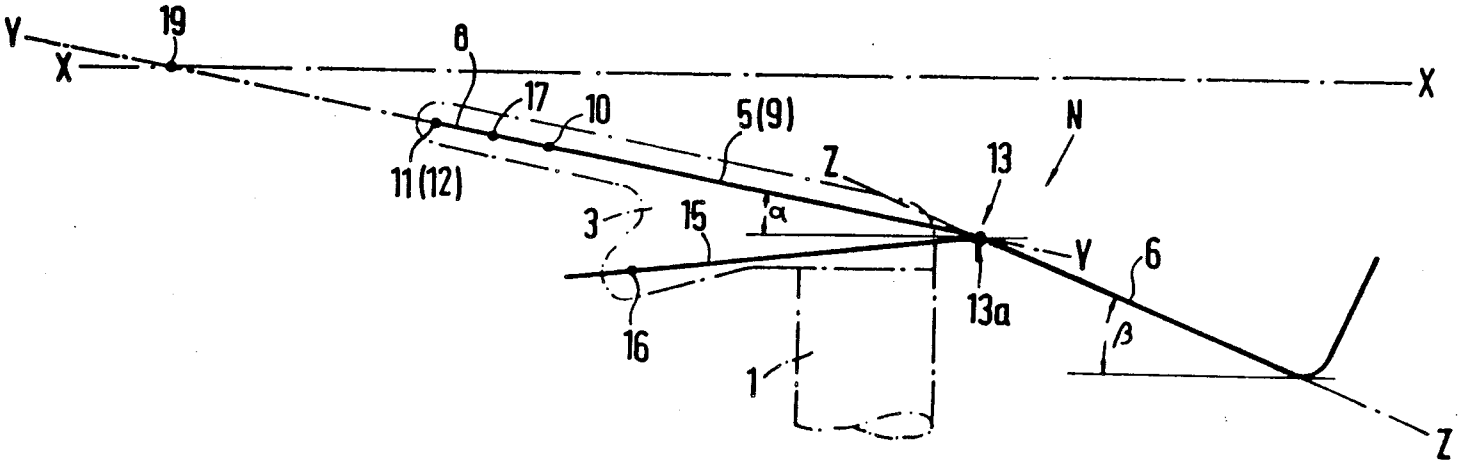
FIG. 3 is a diagrammatic representation of the coupling elements of the control linkage for the chair of FIGS. 1 and 2 in an inclined position.
Figure 4:
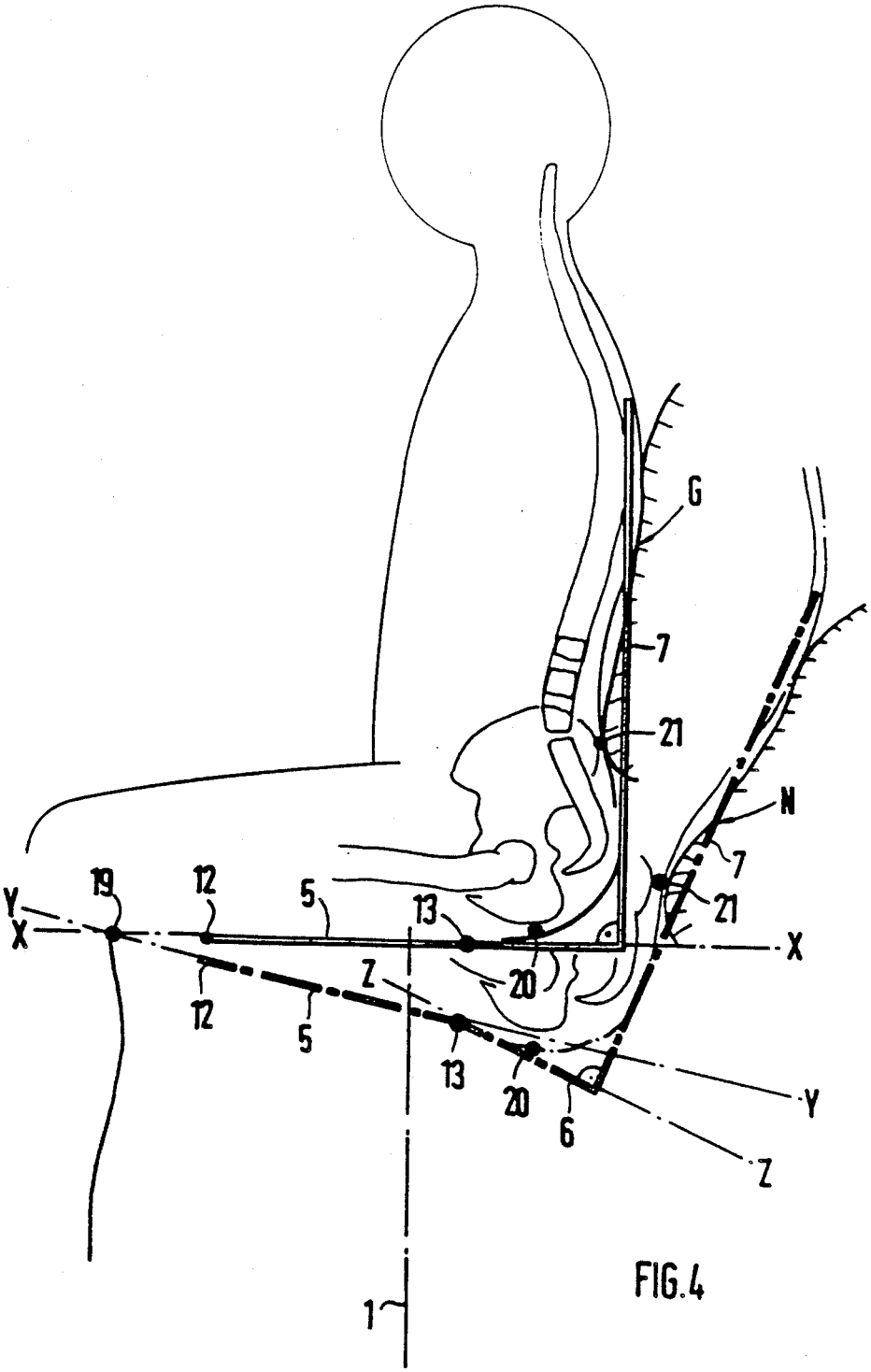
FIG. 4 is a diagramatic representation of the human support points in the chair of FIGS. 1–3 in its two end positions.
Figure 5:
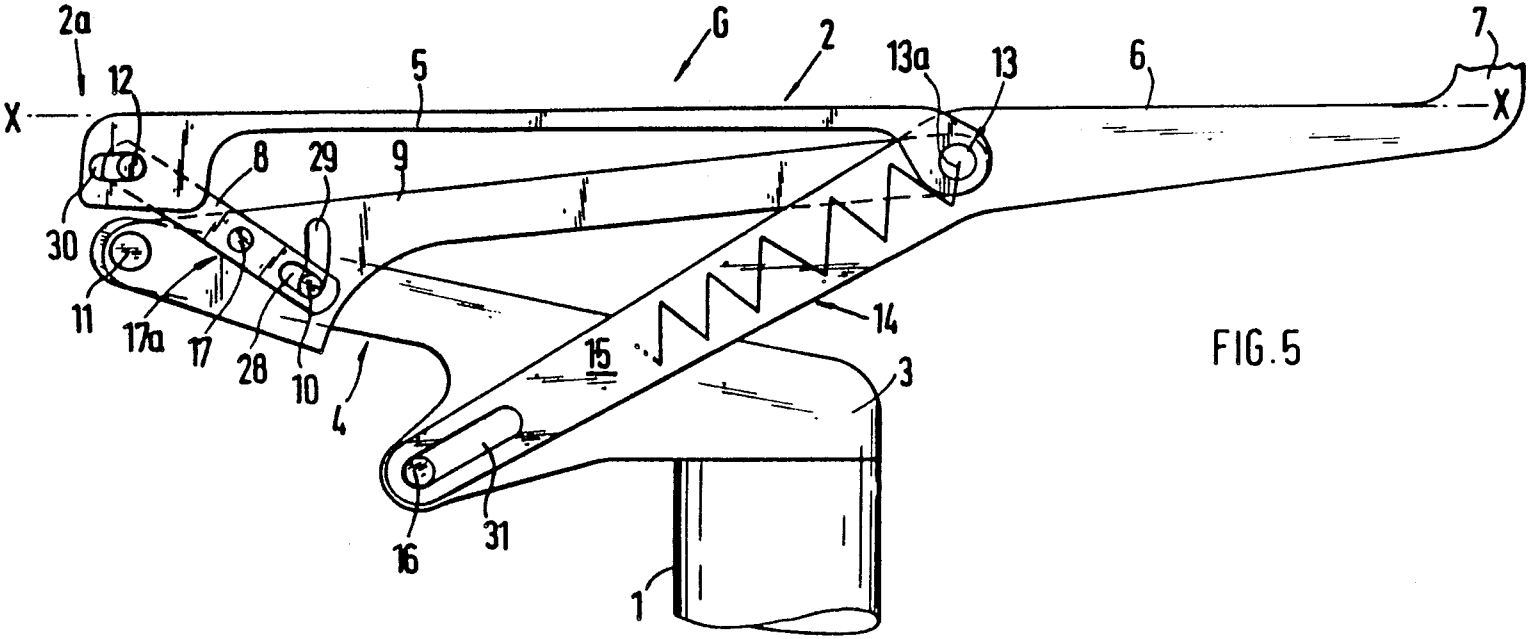
FIG. 5 is a lateral schematic view of the chair of FIGS. 1–4 showing the coupling elements, the seat carrying means and the plate parts of the seat surface.

The axis of rotation 19 in the knee area, in any intermediate position, up to the inclining end position N as shown in FIG. 3, is located approximately unchanged in the horizontal plane X—X. This type of unchanged position of this axis of rotation 19 is achieved by the control linkage 4 that lowers the front plate part 5 below the horizontal plane X—X into the diagonal plane Y—Y. In the intersecting line of these two planes X—X and Y—Y, the axis of rotation 19 is arranged which, as shown in FIG. 4, is located approximately in the area of the user's hollows of the knees.

During the adjustment of the front plate part 5, the rear plate part 6 is simultaneously forcibly pulled into an inclining position in the diagonal plane Z—Z. The angle of slope $\alpha$ of the front plate part 5 is about 12°, and the angle of slope $\beta$ of the rear plate part 6 is about 24°, which corresponds to a ratio of 1:2.

The rear plate part 6 is integral with the backrest 7 and can be inclined jointly around the axis 13*a* located in front of the pelvis in the direction of the front plate part 5. As shown in FIG. 4, a human being has two relevant support points 20 and 21 in the pelvic area that are correspondingly arranged in the seat surface and the backrest. These support points 20 and 21, when the chair is adjusted into position N, do not change their position with respect to the chair so that no relative movement can occur between the backrest 7 of the seat surface 2 and the user.

Figures 6, 6A:
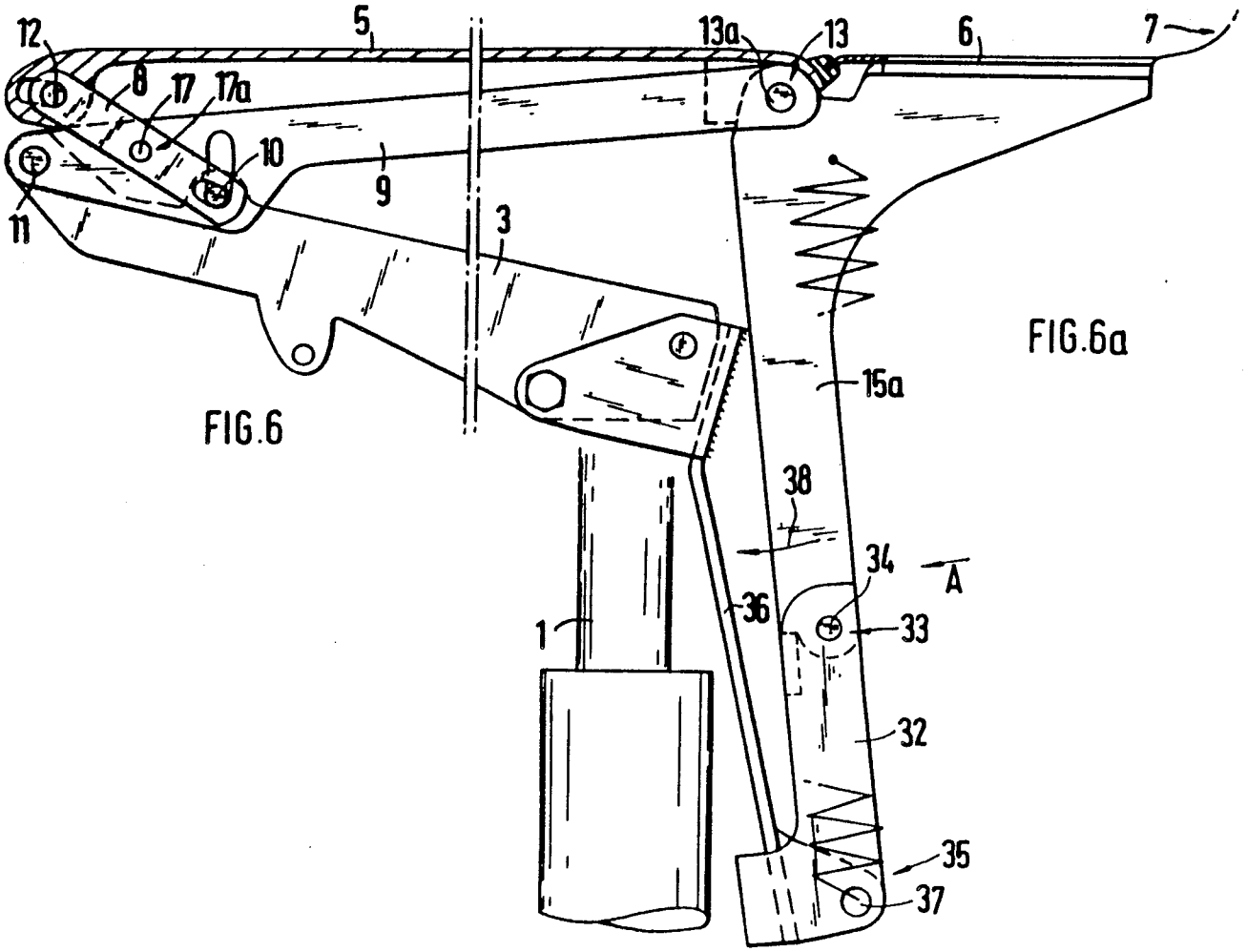
FIG. 6 is a lateral view of a portion of the control linkage according to FIG. 5.
FIG. 6*a* depicts a further embodiment of a rear portion of the control linkage, which is connected with a front portion of the control linkage according to FIG. 5.
Figures 7, 7A:
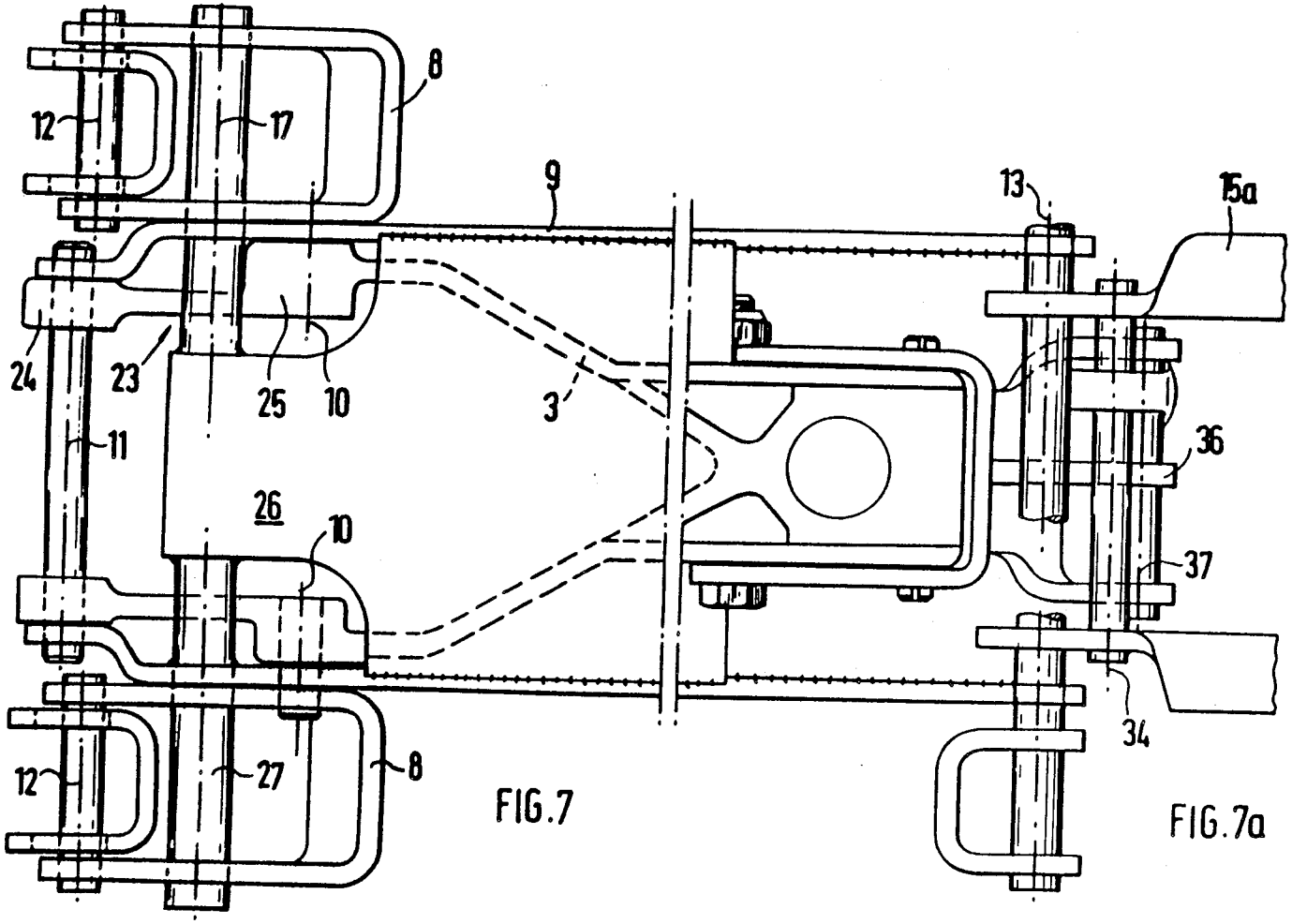
FIG. 7 is a top view of FIG. 6.
FIG. 7*a* is a top view of FIG. 6*a;*
Figure 8:
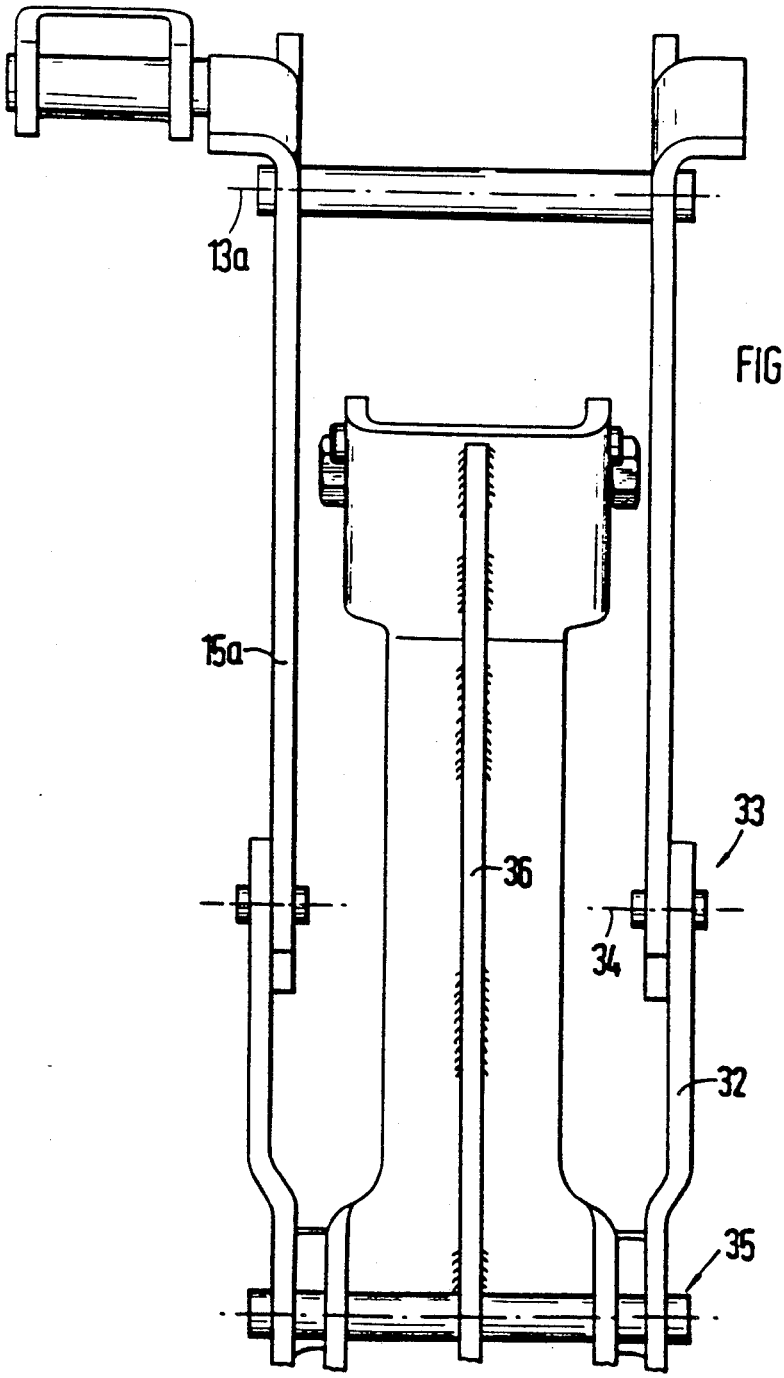
FIG. 8 is a view taken in the direction of the Arrow A of FIG. 6*a;*

In FIGS. 6 and 7, a constructive design of a chair with the control linkage 4 is shown in detail, in which case FIGS. 6 and 7 show a construction that corresponds to FIGS. 1, 2, 3 and 5. The seat carrying means 3 has arms that are guided toward the front and at their free ends 23 have bearing lugs 24, 25 with the horizontal shafts 10 and 11. Located on the outside with respect to these bearing lugs 24, 25, at both sides of the seat carrying means 3, coupling elements 9 are arranged that are held via a plane connecting element 26 arranged above the seat carrying means 3 which is firmly connected with the journals 27 that form the shafts 17. Longitudinal slots 28, 29, 30 and 31 in the joints of the coupling elements 8 and 9, in the front plate part 5 and in the control arm 15, permit a moving of the individual parts that is free from jamming as well as a guided sequence of movements corresponding to the angle adjustment of the two plate parts 5 and 6 when the slope of the seat is adjusted. The parts of the control linkage, such as the coupling elements, the seat carrying means and the two plate parts may consist of cast parts or may be constructed as sheet-metal parts. The longitudinal slot 29 actually has no function with respect to the sequence of movements, but must grant free movement to the guide bolt 10 penetrating the control rod 9.

Another embodiment is shown in FIGS. 6*a* and 7*a*. In the case of this embodiment, the control arm 15 according to the embodiments of FIGS. 1, 2, 3 and 5 is constructed as a vertically extending control arm 15*a*. This control arm 15*a* is connected via a buckle joint 33 with a horizontal axis 34 of rotation with a connecting vertical support carrier 32, via a buckle joint 33. The free end 35 of the support carrier 32 can be swung around a horizontal shaft 37 in a bracket 36 that is firmly connected with the frame 1. The coupling elements 8, 9, the plate parts 5, 6 and the backrest 7 correspond to the embodiment according to FIGS. 6 and 7.

Figure 2:
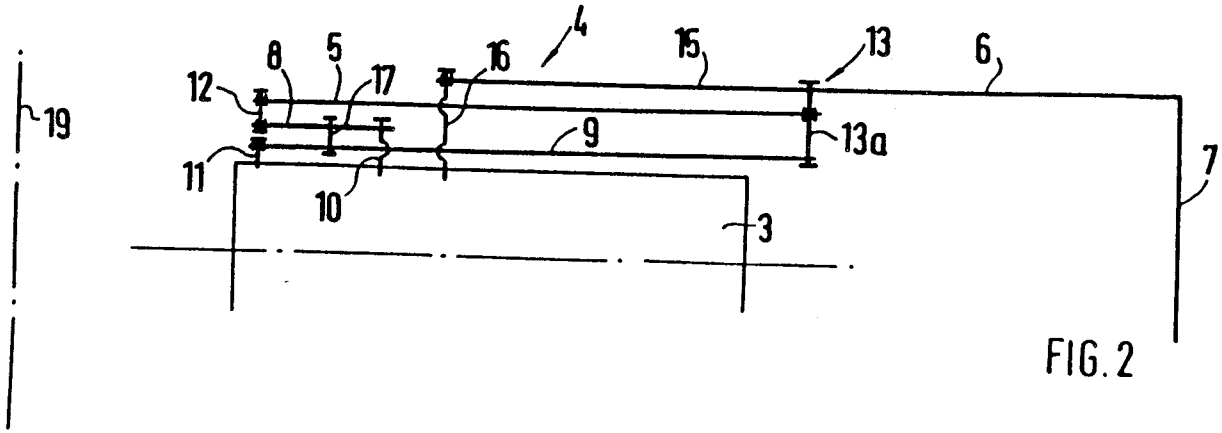
FIG. 2 is a top view of FIG. 1.
Figure 10:
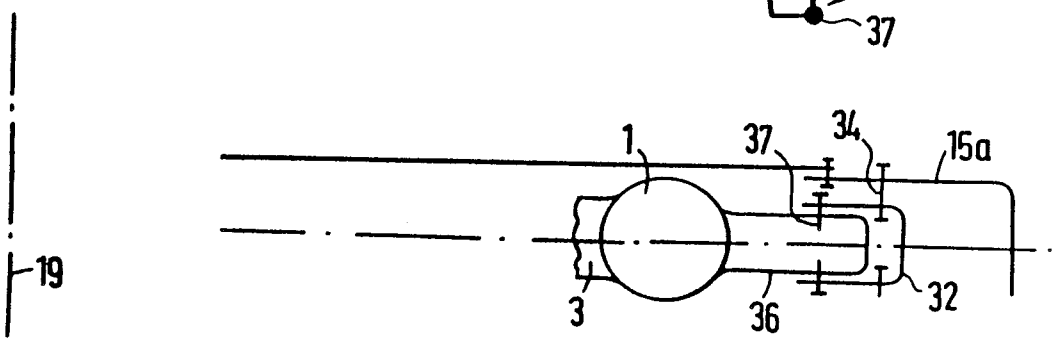
FIG. 10 is a diagrammatic representation of a top view of FIG. 9 corresponding to FIG. 7*a.*

The method of operation of the embodiment according to FIGS. 6*a* and 7*a* is shown in diagram form in FIG. 10 and takes place in such a way that, when pressure is exercised on the rear plate part 6, the control arm 15*a* swings in the direction of the arrow 38 around the axis 13*a* of the joint 13 while taking along the supporting struts 32 around the buckle joint 33. During this swinging process, the control linkage 4 operates in the way that is shown in FIGS. 1, 2 and 3.

Figure 9:
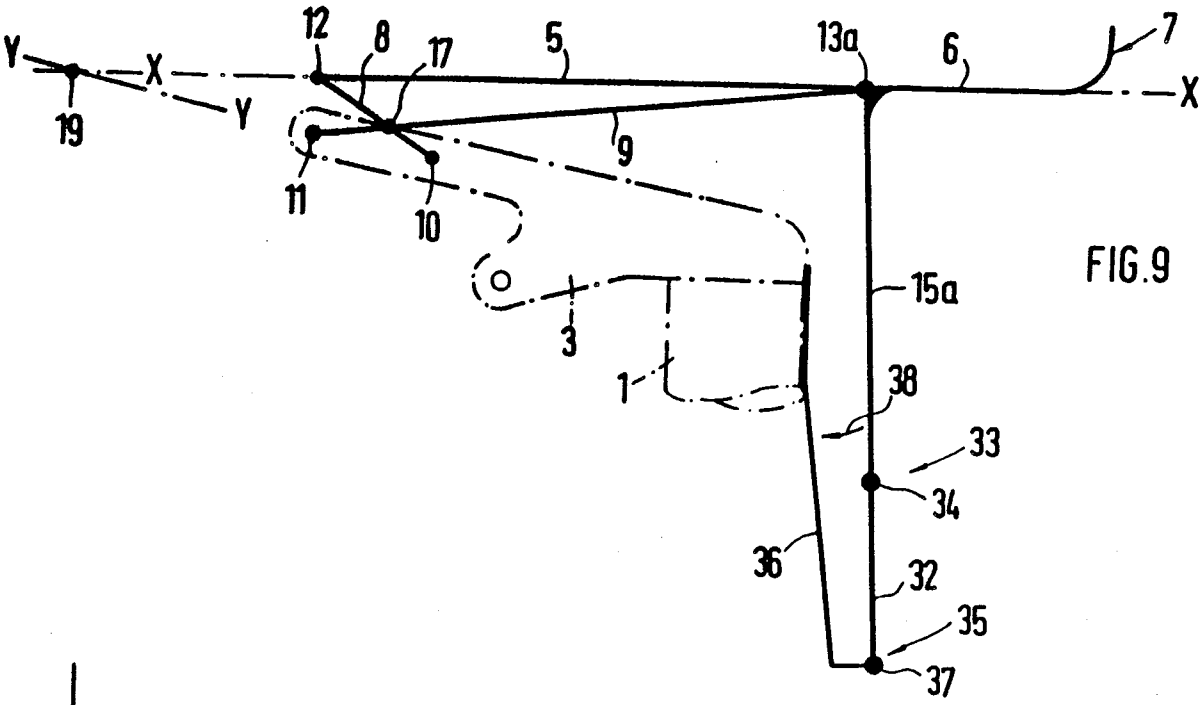
FIG. 9 is a side view diagrammatic representation of the control linkage according to FIG. 6*a* shown in a basic position.

The reason for the special development of the guide rods 15*a* and 32 (FIGS. 9 and 10) is the following: When the chair is "sat on" in the front area (plate 5, up to the joint 13*a*), no spring deflection takes place. The chair is quasi locked. It is only when the rear part of the plate 6 and the backrest 7 are subjected to a load, that, as described, the inclining of the seat is initiated.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A chair, particularly an office chair, having a vertically adjustable seat carrying means including at least two seat plate means for adjusting the slope of the seat by means of a control linkage, one of said seat plate means being adjustable in its slope and fixedly attached to a seat backrest, and said seat backrest being adjusted as a function of the slope of the said one seat plate means, said control linkage having at least two coupling elements that are held at the seat carrying means and are arranged in the shape of scissors, said coupling elements being coupled with said at least two plate means, a seat surface connected to said at least two plate means for inclination therewith as said one seat plate means has its slope adjusted and said at least two seat plate means being flexibly connected with one another to form an imaginary, height unchangeable transversely extending axis of rotation in a knee area that is located in front of the seat surface, said axis of rotation being located on an intersecting line formed by a horizontal plane of the seat surface when adjusted to a horizontal position and along a diagonal plane of one coupling element when said one seat plate means is sloped to an inclined adjusted position.

2. A chair according to claim 1, wherein the coupling elements are arranged in the shape of scissors and are connected with one another via a joint located between the ends of both coupling elements, wherein a first of said coupling elements extends toward a front edge of the seat surface and is coupled to the other of said at least two seat plate means via a horizontal axis of rotation in an area of this front edge of the seat surface, and wherein a second of said coupling elements extends toward a rear side of the seat surface and is connected with both said at least two plate means via a rear joint.

3. A chair according to claim 2, wherein said one plate means is integral with the backrest, and wherein both said at least two plate means are connected via said rear joint, and wherein a transversely extending axis of said rear joint is arranged in front of a normal pelvis location of said seat surface.

4. A chair according to claim 2, wherein said one plate means has a portion means that extends beyond said rear joint and includes control arms which are coupled at the seat carrying means to be rotatable about a horizontal axis.

5. A chair according to claim 1, wherein the at least two seat plate means are adjusted via the control linkage that, in a basic seat surface adjusted position, they occupy a straight position therebetween which is located in a longitudinal horizontal plane, and in an inclined seat surface adjusted position, the one of said seat plate means has a more extensive slope in a diagonal plane than does the other of said two plate means.

6. A chair according to claim 5, wherein the other of said at least two plate means has a front edge that is located below said horizontal seat surface plane when the seat surface is inclined to its adjusted position.

7. A chair according to claim 1, wherein relative lengths of the control linkage cause the other of said two seat plate means to be sloped at an angle to the horizontal at a ratio of 1:2 with respect to the angle of sloping of the one of said two seat plate means in the inclined adjusted position as well as in intermediate positions of the seat surface.

8. A chair according to claim 1, wherein one of said coupling elements coupled to said one of said seat plate means has a slot with a length permitting relative movement between one end of said one coupling element and the other coupling element to allow for connection of said one coupling element to said seat carrying means.

9. A chair according to claim 1, wherein said one of said at least two plate means extends beyond a joint connecting the two plate means and has control arms which extend in a vertical direction and are connected with a seat supporting carrier at a joint around a horizontal shaft, and wherein the supporting carrier can be swung around another horizontal shaft at a bracket of the seat carrying means.

10. A chair according to claim 1, wherein there are plural sets of the at least two coupling elements, one set at each side of the chair and wherein one of the coupling elements are two members directed to a rear side of the seat surface and receive the seat carrying means between them and the other coupling elements include two members that are coupled to the outside of said first two coupling means and which extend to a front edge of the seat.

11. A chair according to claim 1, wherein the coupling elements connected to the other of said at least two seat plate means are in a U-profile shape, and wherein between legs of this U, the other seat, plate means is coupled to the U-profile shape around a horizontal shaft.

* * * * *